US005342227A

United States Patent [19]

Suganuma

[11] Patent Number: 5,342,227

[45] Date of Patent: Aug. 30, 1994

[54] WATER JET PROPULSION UNIT

[75] Inventor: Noboru Suganuma, Hamamatsu, Japan

[73] Assignee: Sanshin Kogyo Kabushiki Kaisha, Shizuoka, Japan

[21] Appl. No.: 48,477

[22] Filed: Apr. 16, 1993

[30] Foreign Application Priority Data

May 27, 1992 [JP] Japan ..... 4-160300

[51] Int. Cl.[5] ..... B63H 11/00

[52] U.S. Cl. ..... 440/38

[58] Field of Search ..... 440/38, 39, 46, 47; 60/221; 210/521, 800, 801; 209/208, 210

[56] References Cited

U.S. PATENT DOCUMENTS 3,233,573 2/1966 Hamilton ..... 440/39
3,362,542 1/1968 Stevens ..... 210/801
4,994,176 2/1991 Yakunin et al. ..... 209/210

*Primary Examiner*—Edwin L. Swinehart
*Attorney, Agent, or Firm*—Knobbe, Martens, Olson & Bear

[57] ABSTRACT

A water jet propulsion unit for a watercraft including a separator for extracting a portion of the water pumped by the jet propulsion unit for another purpose while removing foreign particles from the separated water and returning them to the jet propulsion unit to avoid clogging of the external water supply.

8 Claims, 6 Drawing Sheets

WATER JET PROPULSION UNIT

BACKGROUND OF THE INVENTION

This invention relates to a water jet propulsion unit and more particularly to an improved arrangement for picking off a portion of the water pumped by the jet propulsion unit and using it for another purpose and separating foreign articles from the picked-off water and returning them to the jet propulsion unit.

Water jet propulsion units have a number of advantages over more conventional propeller type systems. For example, it is possible to operate the watercraft powered by the jet propulsion unit in much shallower water than with conventional propellers. In addition, a portion of the water which is circulated by the impeller of the jet propulsion unit can be used for a variety of other purposes. For example, this water may be delivered to the cooling jacket of the engine for circulation therethrough. Alternatively, the diverted water can be employed to operate a venturi type of pump for pumping water from the bilge of the watercraft.

In connection with these uses of the diverted water, there is, however, a problem. Because of the fact that the jet propulsion unit can be operated in shallow water, there is a likelihood that foreign particles may be pumped through the jet propulsion unit. This is true even if a strainer is utilized for the main portion of the jet propulsion unit. Such strainers are employed only to remove extremely coarse articles since smaller particles can present no basic problem to the operation of the jet propulsion unit.

If, however, these smaller particles are passed into the conduit that supplies the tapped off water, they can obstruct its flow. If the water is used for the cooling system of the engine, this will mean that the engine can be inadequately cooled. Alternatively, if the drawn off water is utilized for a venturi pump, then the venturi pump can itself become clogged.

It has been proposed to avoid these difficulties by providing a strainer in the drawn off water conduit. However, the strainer itself can become clogged and the same results will occur unless the strainer is serviced frequently.

It is, therefore, a principal object of this invention to provide an improved arrangement for separating foreign particles from the water drawn off of a jet propulsion unit.

It is a further object of this invention to provide a separator for such water wherein the removed particles will be returned and disposed of through the jet propulsion unit.

It is a further object of the invention to provide a separator for such water that will not require servicing.

SUMMARY OF THE INVENTION

This invention is adapted to be embodied in a water jet propulsion unit for a watercraft that comprises a water inlet opening through which water may be drawn from the body of water in which the watercraft is operating, an impeller portion containing an impeller for pumping the water and a discharge nozzle for discharging the water pumped by the impeller for propelling the watercraft. A separator device is provided for separating particles from the water and for drawing off a portion of the water pumped by the impeller. This separator device includes an inlet that communicates the separator device with the jet propulsion unit for receiving a portion of the water pumped by the impeller and for returning the separated particles to the jet propulsion unit and an outlet for receiving the separated water for a purpose other than propulsion of the watercraft.

DETAILED DESCRIPTION OF THE PREFERRED EMBODIMENTS OF THE INVENTION

Figure 1:
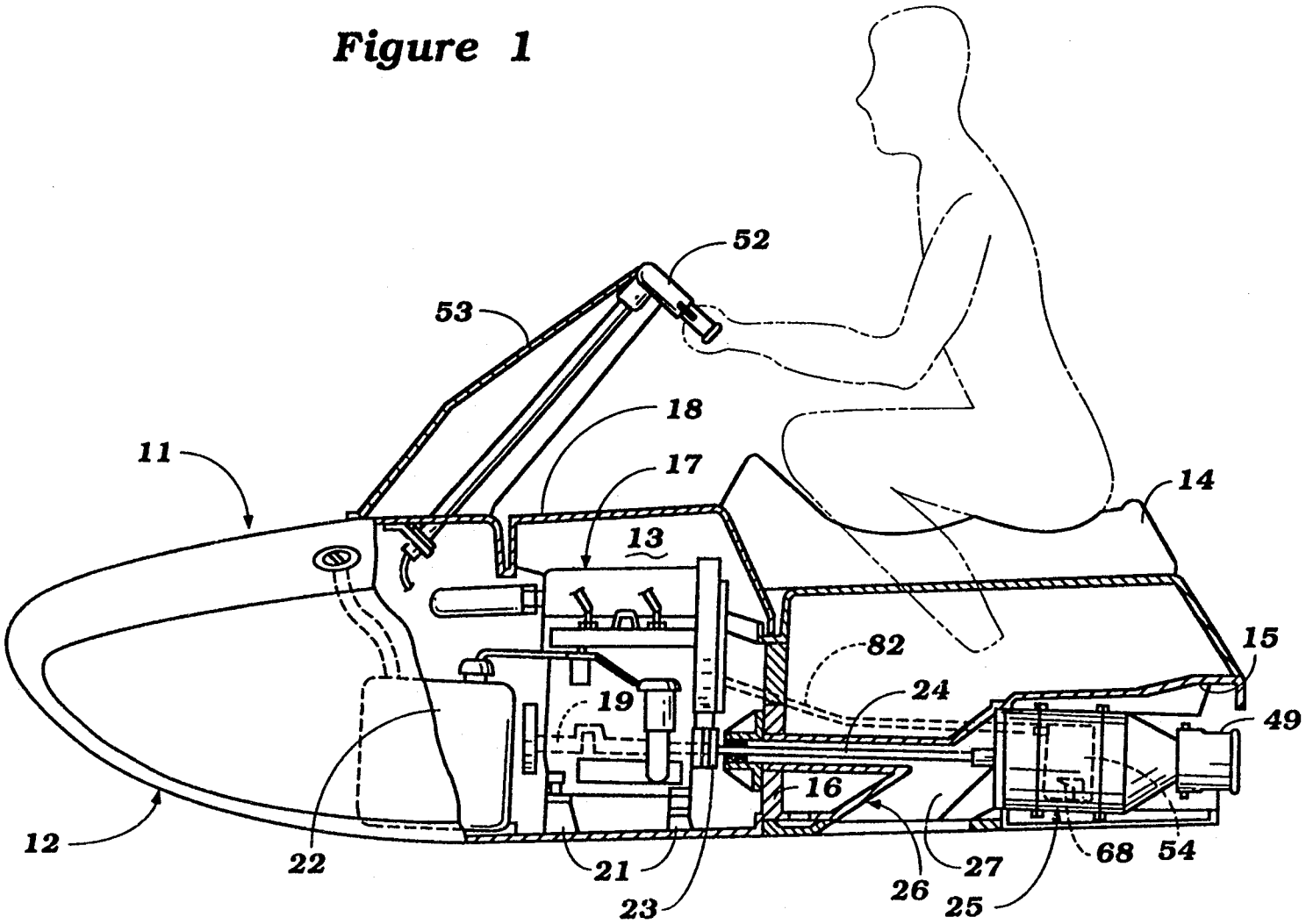
FIG. 1 is a side elevational view of a small watercraft constructed in accordance with an embodiment of the invention.

Referring now in detail to the drawings and initially to FIG. 1, a small jet propelled watercraft constructed in accordance with an embodiment of the invention is identified generally by the reference numeral 11. It is to be understood that the watercraft 11 is exemplary only of one form of watercraft in which the invention may be practiced. However, it is to be understood that the invention does have particular utility in conjunction with jet propelled watercraft.

Watercraft 11 is comprised of a hull assembly, indicated generally by the reference numeral 12, and which may be formed from any suitable material such as a molded fiberglass reinforced resin or the like. The hull 12 defines a forwardly positioned engine compartment 13, a rearwardly positioned rider's area including a seat 14 and a tunnel 15 that is positioned beneath the seat 14 and which is separated from the engine compartment 13 by means of a bulkhead 16. In the illustrated embodiment, the seat 14 is adapted to accommodate a single rider seated in straddle fashion.

An internal combustion engine, indicated generally by the reference numeral 17, is provided in the engine compartment 13 forwardly of the bulkhead. The engine 17 may be accessible for service by removal of a hatch cover 18 which is positioned forwardly of the seat 14. The engine 17 in the illustrated embodiment is of the two cycle crankcase compression type having two cylinders which drive a crankshaft 19 in a well known manner. This engine 17 is mounted within the engine compartment 13 on a pair of engine mounts 21 in a well known manner.

A fuel tank 22 is positioned in the engine compartment 13 forwardly of the engine 17 and supplies fuel to the charge forming system of the engine.

The crankshaft 19 drives an elastic coupling 23 which, in turn, is coupled to an impeller shaft 24 of a jet propulsion unit, indicated generally by the reference numeral 25, and which jet propulsion unit is mounted in the tunnel 15 to the rear of the bulkhead 16. The impeller shaft 24 extends through the bulkhead 16 to the coupling 23.

The jet propulsion unit 25 is comprised of a water inlet portion 26 which defines a water inlet duct 27 through which water may be drawn from the body of water in which the watercraft is operating. The water inlet duct 27 may be formed as a portion of the hull 12.

Figure 2:
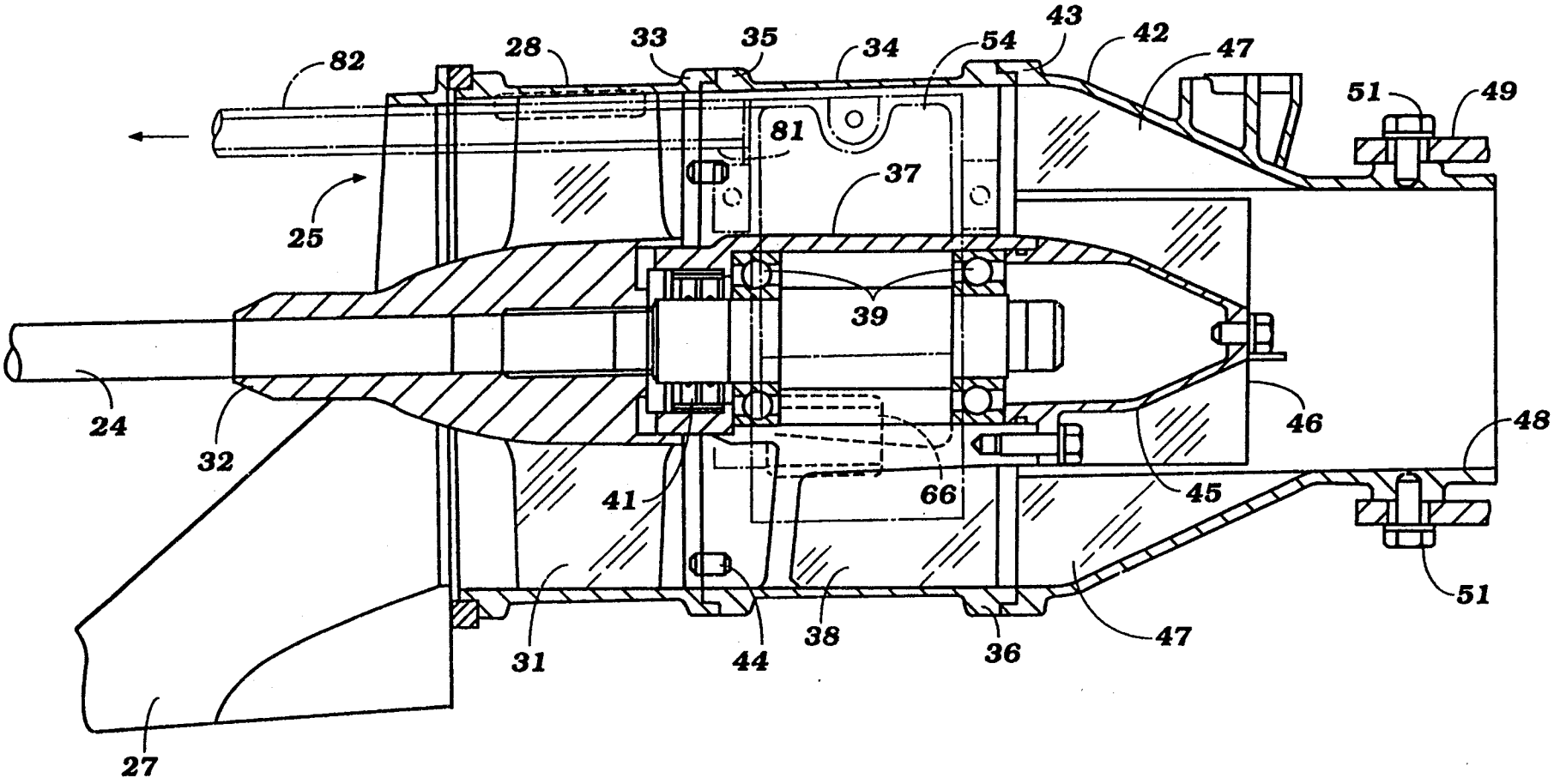
FIG. 2 is an enlarged cross-sectional view taken through the jet propulsion unit.
Figure 3:
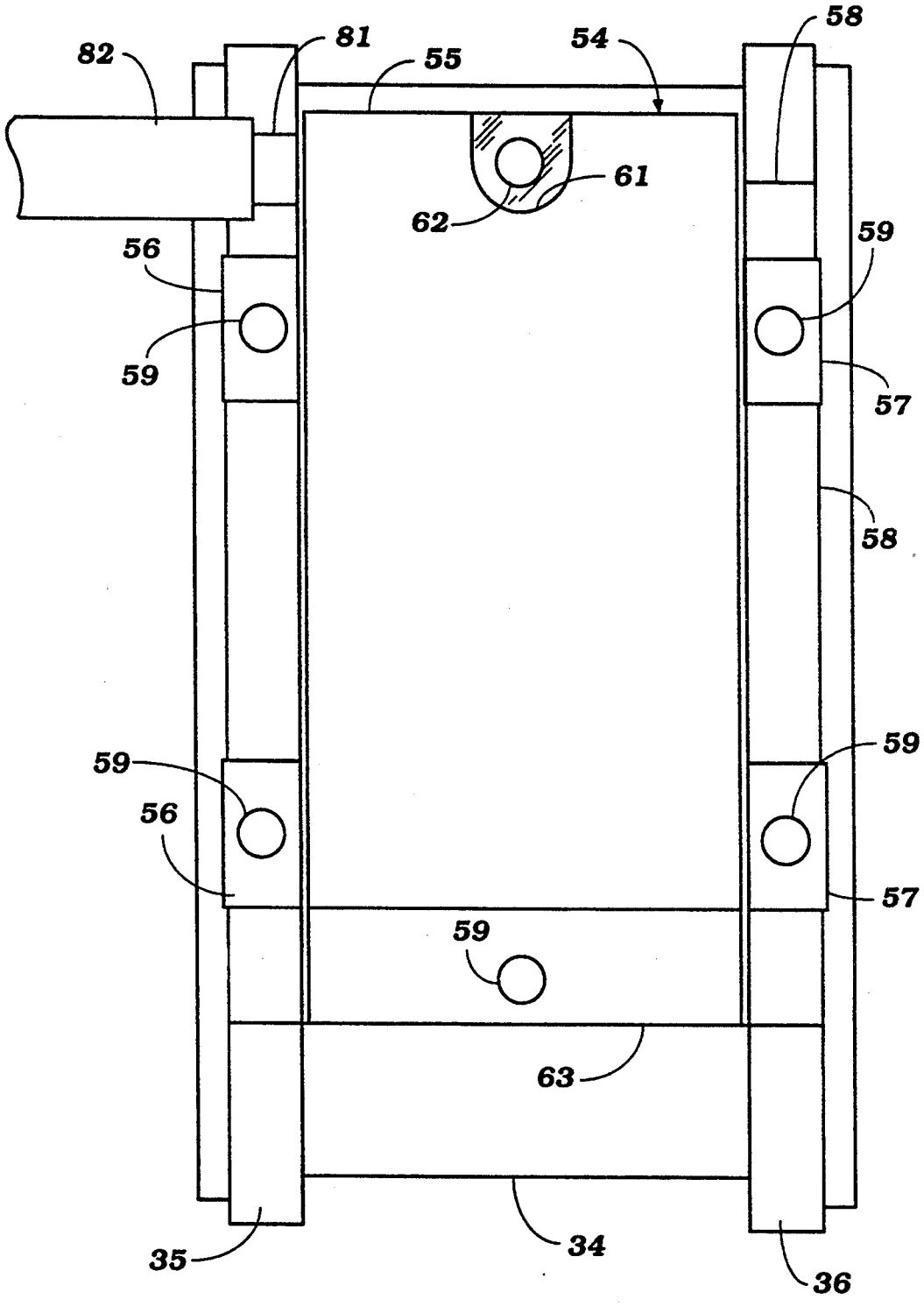
FIG. 3 is a side elevational view showing the exterior of the water separation device but illustrating it mounted on the side of the jet propulsion unit opposite to the side as shown in FIGS. 1 and 2.

Referring now additionally and primarily to FIG. 2, the jet propulsion unit 25 includes in addition to the water inlet portion 27, an impeller housing portion 28 in which an impeller 31 is journaled, in a manner to be described. The impeller 31 has a forwardly extending portion 32 which is received around and journals the impeller shaft 24 in a suitable manner.

A flange 33 of the impeller housing 28 interconnects the impeller housing 28 to a further stator housing 34 which has a pair of peripheral flanges 35 and 36. A nacelle 37 is formed integrally with the housing 34 and has a plurality of straightening vanes 38 which receive the water pumped by the impeller 31 and cause it to flow rearwardly in an axial direction. The nacelle 37 supports the rear end of the impeller shaft 24 on a pair of bearings 39 with a seal 41 being positioned at the forward end of the nacelle 37.

The water pumped past the straightening vanes 38 is discharged into a discharge nozzle portion 42 that has a flange 43 that is matingly engaged with the flange 36 of the straightening vane portion 34. Locating pins 44 may be positioned between the respective housings 28, 34 and 42 for maintaining axial alignment and the desired circumferential location.

The discharge nozzle portion 42 carries an extension 45 of the nacelle 37 and which itself has straightening vanes 46. These straightening vanes also cooperate with further straightening vanes 47 which may be formed in the discharge nozzle portion forwardly of its exit opening 48.

A steering nozzle 49 is pivotally supported at the end of the discharge nozzle portion 42 adjacent the opening 48 on vertically extending pivot pins 51. The steering nozzle 49 is coupled to a handlebar assembly 52 (FIG. 1) carried by a mast 53 at the forward portion of the seat 14 and forwardly of the hatch cover 18 so that the watercraft may be steered in a well known manner.

The construction of the watercraft 11 and the jet propulsion unit 25 as thus far described may be considered to be conventional. That is, the portion of the watercraft 11 and jet propulsion unit 25 as thus far described form no part of the invention but rather the environment in which the invention can be practiced.

In accordance with the invention, a portion of the water pumped by the impeller 31 is diverted for any of a plurality of purposes, as will be described. This water is diverted to a separator, indicated generally by the reference numeral 54, and constructed in accordance with an embodiment of the invention. The separator 54 is shown in most detail in FIGS. 3–8, although it does appear out of position in FIGS. 1 and 2.

The water separator 54 has a generally rectangular configuration as viewed in side elevation and is formed by an outer housing 55 that has pairs of side lugs 56 and 57 which engage bosses 58 formed on the flanges 35 and 36 of the straightening vane housing 34. These bosses 58 have tapped holes and the lugs 56 and 57 have apertures 59 so as to receive threaded fasteners (not shown) so as to affix the separator 54 to the jet propulsion unit 25. In addition, there is provided an upper boss or recess 61 in which an opening 62 is formed so as to pass a further threaded fastener. In a like manner, a lower cross piece 63 is formed with a further opening 64 so as to receive an additional threaded fastener so as to complete the securement of the separator 54 to the jet propulsion unit 25.

The jet propulsion unit housing portion 34 has a generally cylindrical inner surface 65 in which a water diversion opening 66 is formed at a point below the rotational axis 60 of the impeller shaft 24 and impeller 31. It will be noted that the lower wall which defines the opening 66 extends generally horizontally while the upper wall is tapered upwardly and outwardly.

Figure 4:
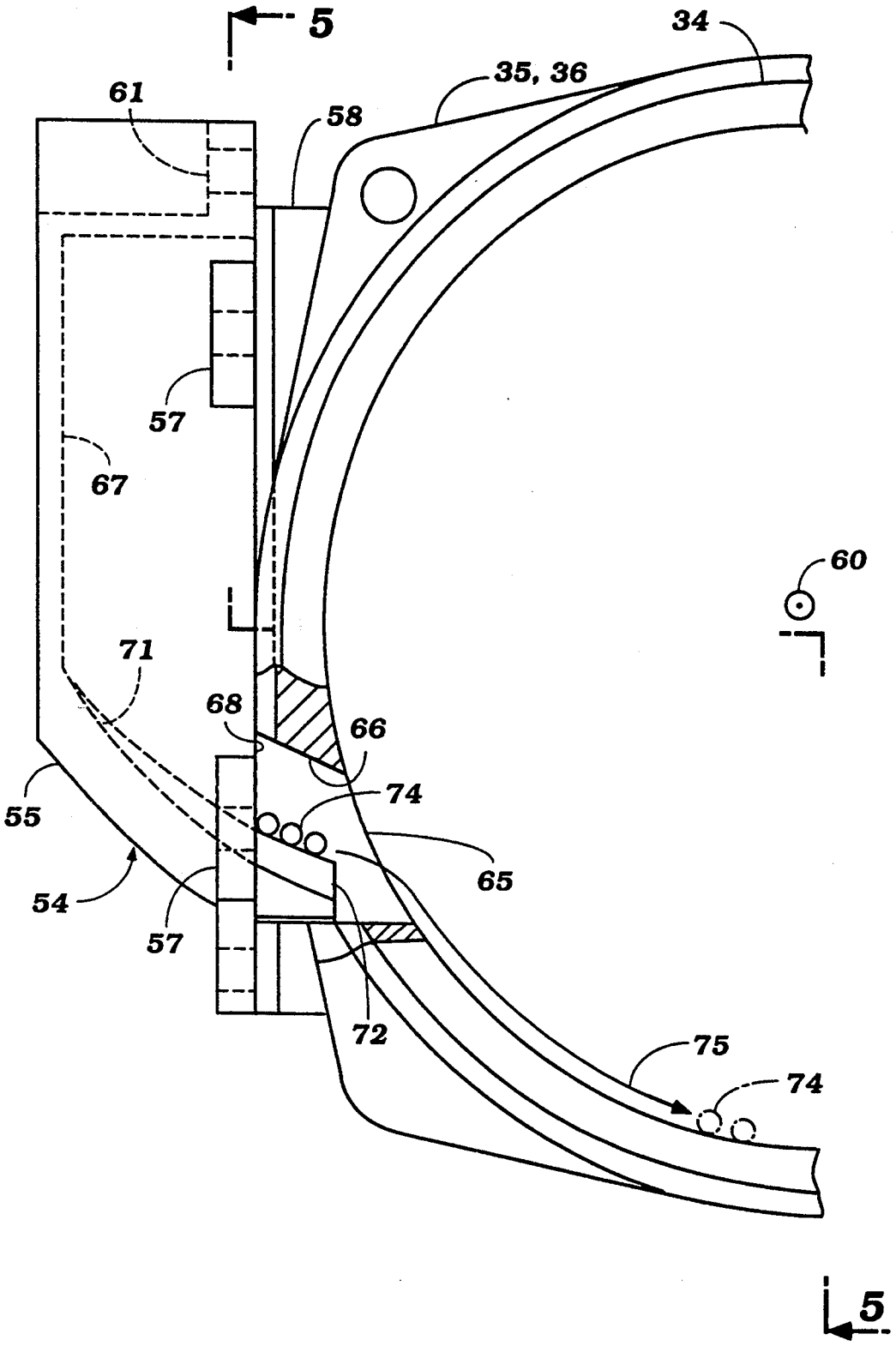
FIG. 4 is a rear elevational view of a portion of the construction as shown in FIG. 3, with a portion broken away so as to more clearly show how the water separator device cooperates with the jet propulsion unit.
Figure 5:
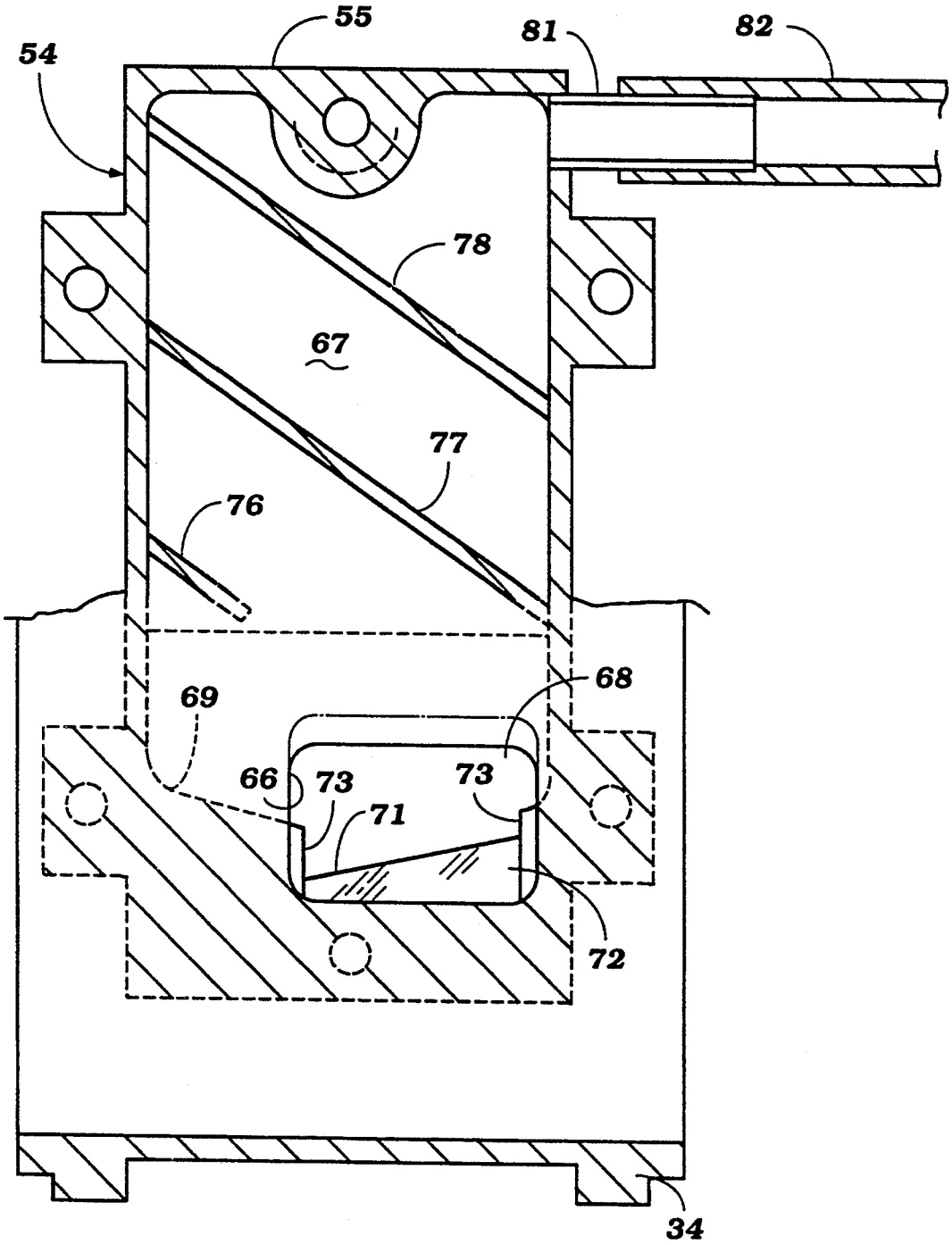
FIG. 5 is a cross-sectional view taken along the line 5—5 of FIG. 4.
Figure 6:
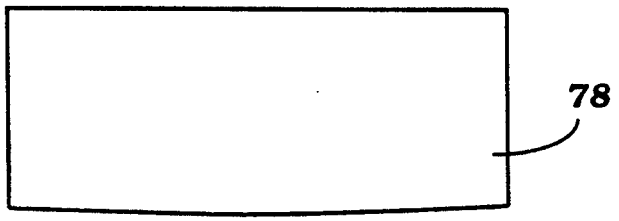
FIG. 6 is a view showing one of the baffles of the water separator.
Figure 7:
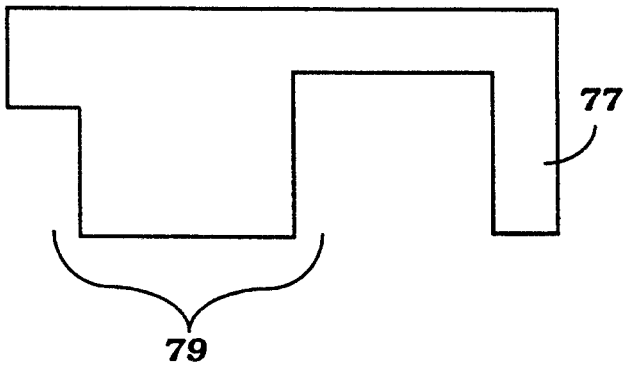
FIG. 7 is a view showing another of the baffles of the water separator.
Figure 8:
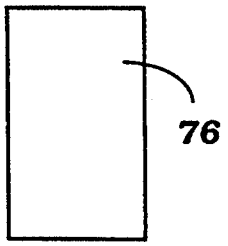
FIG. 8 is a view showing the final baffle of the water separator.

The separator 54 and particularly its housing 55 defines an internal cavity 67 which forms in part an opening 68 that registers with the jet propulsion unit housing portion opening 66. The opening 68 is defined in part by a pair of downwardly inclined lower surfaces 69 and 71 which face the opening 66 as shown in FIG. 4. A projection 72 is formed in the face of the housing 55 which extends into the jet propulsion unit housing opening 66 but which terminates outwardly of the inner surface 65. Also, it should be noted that the protrusion 72 is somewhat essentric to the shape of the cavity 67. This is because the cavity 67 is disposed somewhat eccentrically to the opening 66 in the housing portion 34 so as to cause a labyrinthine type of water flow through the housing cavity 67. In addition, the forward edge of the projection 72 will tend to obstruct large foreign particles from entering into the cavity 67 of the separator 54. Smaller particles, indicated at 74 may, however, reach the opening and try to enter the cavity 67. However, these particles 74 will be separated, in a manner to be described, and returned into the jet propulsion unit 25 in the path shown by the arrow 75 in FIG. 4.

Vertically within the cavity 67 there are positioned three inclined baffles comprised of a lower baffle 76, a middle baffle 77 and an upper baffle 78. The lower baffle 76 (FIG. 6) is generally rectangular in configuration and does not extend from one end of the cavity 67 to the other but does extend substantially across the width of the cavity. The baffle 77 (FIG. 7), on the other hand, extends along the width of the cavity 67 but is provided with a pair of cut-outs 79 through which water may flow. As may be seen, the cut-outs 79 are staggered slightly from each other.

The width of the baffle 77 is equal to the width of the cavity 67.

The upper baffle 78 (FIG. 8) extends the full depth of the cavity 67 but does not occupy its full width. Hence, it should be readily apparent that the baffles 76, 77 and 78 will cause a Labyrinthine flow of water from the inlet opening 66 to a discharge nozzle 81 positioned at the upper end thereof. Thus, any foreign particles that may be trapped in the water that is delivered through the inlet opening 66 will be separated by this flow and by gravity. Also, since the volume of the chamber 67 is substantially greater than the cross-sectional area of the opening 66, the water flow velocity will be relatively slow through it and foreign particles will tend not to be swept out of the discharge nozzle 81.

A flexible conduit 82 delivers the water from which foreign particles have been separated to either the cooling jacket of the engine 17 and/or a venturi type of pump for pumping water from the bilge of the hull 12. Thus, it should be readily apparent that the described construction provides water from which all possible obstructing foreign particles could have moved to either the engine cooling jacket and/or the venturi jet pump. Of course, the foregoing description is that of a preferred embodiment of the invention and various changes and modifications may be made without departing from the spirit and scope of the invention, as defined by the appended claims.

I claim:

1. A water jet propulsion unit for a watercraft comprising a water inlet portion defining a water inlet through which water may be drawn from the body of water in which the watercraft is operating, an impeller portion containing an impeller for pumping water and a discharge nozzle portion through which water pumped by said impeller is discharged for propelling the watercraft, a separator device for separating foreign particles from said water, an inlet opening communicating said separator device with a side of said jet propulsion unit for receiving a portion of the water pumped by said impeller and returning the separated particles to said jet propulsion unit, and outlet opening for receiving the water from which particles have been separated, and means defining a flow path from said inlet opening to said outlet opening including a horizontally extending portion terminating at a wall disposed in confronting relation to said inlet opening to turn and redirect the flow of water from said horizontally extending portion vertically along said side of said jet propulsion unit for reducing the velocity of water and particles passing through said inlet opening.

2. A water jet propulsion unit as set forth in claim 1 wherein the inlet is positioned vertically beneath the outlet.

3. A water jet propulsion unit as set forth in claim 2 further including baffle means extending across portions of the flow path of the separator device.

4. A water jet propulsion unit as set forth in claim 3 wherein the inlet is defined in part by an inclined lower wall integrally formed with the vertically extending wall and for obscuring a further portion of the inlet area for removing larger particles and for returning separated particles to the jet propulsion unit.

5. A water jet propulsion unit as set forth in claim 3 wherein the baffle means comprises a plurality of baffles that provide staggered openings for defining a labyrinthine flow path through the separator.

6. A water jet propulsion unit as set forth in claim 5 wherein the inlet is defined in part by an inclined lower wall integrally formed with the vertically extending wall and for obscuring a further portion of the inlet area for removing larger particles and for returning separated particles to the jet propulsion unit.

7. A water jet propulsion unit as set forth in claim 6 wherein the separator device has an internal cavity with an area substantially greater than the area of the inlet opening for reducing the velocity of the water flowing through the separator device.

8. A water jet propulsion unit as set forth in claim 1 wherein the separator device has an internal cavity with an area substantially greater than the area of the inlet opening for reducing the velocity of the water flowing through the separator device.

* * * * *